United States Patent [19]

Josephson

[11] 4,305,427

[45] Dec. 15, 1981

[54] DAMPER ASSEMBLY

[75] Inventor: Louis Josephson, Yonkers, N.Y.

[73] Assignee: American Hardware & Paint Co., Inc., Elizabeth, N.J.

[21] Appl. No.: 190,394

[22] Filed: Sep. 24, 1980

[51] Int. Cl.[3] ..... F24F 13/14

[52] U.S. Cl. ..... 137/601; 98/110

[58] Field of Search ..... 49/74, 77, 109; 98/110; 137/601

[56] References Cited

U.S. PATENT DOCUMENTS

| | | | |
|---|---|---|---|
| 2,210,869 | 8/1940 | Larson | 49/74 X |
| 3,044,387 | 7/1962 | Hinden | 137/601 X |
| 3,267,962 | 8/1966 | Josephson | 137/601 |
| 3,447,443 | 6/1969 | Silvey | 137/601 X |
| 3,783,768 | 1/1974 | Caming | 98/110 |
| 3,793,932 | 2/1974 | Tarnoff | 98/110 |
| 3,832,940 | 9/1974 | Hess | 137/601 X |

*Primary Examiner*—Robert G. Nilson

*Attorney, Agent, or Firm*—Dressler, Goldsmith, Shore, Sutker & Milnamow, Ltd.

[57] ABSTRACT

A multiblade damper assembly having at least three pivotally mounted blades is provided with means to interlink these blades in which a bracket is secured to each of the blades with each bracket being formed with a pair of parallel extension arms which extend beyond an end of the blades, these arms having opposed openings for receiving a cylindrical pivot at their outer ends. A cylindrical pivot is rotatably mounted in these opposed openings, this cylindrical pivot having a threaded axial bore on at least one end thereof and a cross hole extending therethrough. At least one of the brackets has a second axially bored pivot with a cross hole extending therethrough rotatably secured to the pivot between the arms of said bracket and connecting rods interconnecting pairs of blades by having the opposite ends of each rod secured within the cross holes of said pivots, including both of said rotatably interconnected pivots.

3 Claims, 4 Drawing Figures

DAMPER ASSEMBLY

DESCRIPTION

1. Technical Field

This invention relates to multi-blade damper assemblies used to control the flow of gas through a duct or conduit in which the damper assembly is housed.

2. Background Art

Damper assemblies generally comprise a damper frame, usually of rectangular configuration, within which are pivotally mounted a plurality of damper blades, also usually rectangular, these blades pivoting between a closed position in which they lie in a plane extending across the opening in the frame to block the same, and an open position in which the blades are at an angle to the plane of the frame opening. The blades are interconnected by a linkage so that pivotal movement of one blade is transmitted to the other blades to cause all of the blades to pivot together. In this combined pivotal movement, all of the blades may remain in parallel planes, or they may rotate oppositely.

Prior multi-blade damper assemblies have required precision construction, they have tended to bind, and it has been necessary for all of the blades to be of the same size. These problems are more fully described, together with a partial solution to the problem, in U.S. Pat. No. 3,267,962 issued to myself and Ho Chow on Aug. 23, 1966.

In the invention of U.S. Pat. No. 3,267,962, brackets are mounted on each of the blades, these brackets having an elongated portion which extends outwardly beyond an end of the blade. Centrally positioned blades are provided with a pair of shanks extending transversely in opposite directions from the elongated portion of the bracket. These shanks are swivelly disposed with respect to the bracket to be rotatable on their own axis. Rods are then connected to these shanks to interconnect the centrally positioned blades with blades on both sides thereof. This eliminates the need for precision alignment of the blades and of the brackets on the blades, and the chance of binding is minimized.

The assemblies needed in U.S. Pat. No. 3,267,962 are complex and involve the assembly of many parts as described in the patent. Moreover, in order to equip a multiblade damper for operation, three different brackets are required. One bracket assembly has the swivelly mounted shank on the left side, one has the swivelly mounted shank on the right side, and a third has the swivelly mounted shank on both sides. These complexities add significantly to the cost of construction and they make the assembly task more difficult.

DESCRIPTION OF INVENTION

In this invention, the brackets which are secured to the blades are formed with a pair of parallel extension arms which carry opposed openings for receiving a cylindrical pivot at their outer ends. A cylindrical pivot is rotatably mounted in these opposed openings, the cylindrical pivot being axially bored and having a cross hole extending through the axis of the pivot. The axial bore is threaded so that a set screw can be employed to lock a connecting rod within the cross hole.

As a matter of interest, the bracket, the axially bored cylindrical pivot as described to this point which is bored at only one end thereof, and the set screw are the same as those which were in common use prior to the filing of U.S. Pat. No. 3,267,962. This conventional structure can be used herein on at least one of the end blades of the multiblade damper. It will therefore be evident that the two-armed brackets, at least some of the pivots and the set screw are all commonly available and can be obtained "off the shelf".

It is important to note that the conventional structure used prior to U.S. Pat. No. 3,267,962, while it had many disadvantages, involved no preconnection between the rod holding elements and the brackets. U.S. Pat. No. 3,267,962 in achieving its objectives lost this advantage of not requiring preconnection of the rotatable shanks with the special one-armed brackets which are used in the patent.

In this invention, a blade of a damper having at least three blades is provided with a bored pivot having a cross hole extending therethrough which is rotatably secured to the pivot which is held between the arms of the bracket. The first pivot is used with a first rod to connect the blade to one other blade, and the second pivot is used (with a second rod) to connect with another blade.

A feature of this invention is the capacity to minimize the number of parts which must be used. Accordingly, the rotatable securement of the second pivot to the one which is held between the arms of the bracket is achieved by having the axial bore through both pivots extend entirely through the length of these pivots so that both ends of these pivots are bored through to the cross hole. The bores in each end of these pivots are threaded so that one end can receive a set screw and the second end can receive a threaded shaft to enable a rotatable securement with the other pivot having the same construction.

The rotatable securement between the two pivots is essential for, without such rotatable movement, the structure would bind if there were any imperfections in it. The relative movement in actual practice between the two pivots is very slight, but it is enough to avoid binding of the structure.

BRIEF DESCRIPTION OF DRAWINGS

The invention is illustrated in the accompanying drawings in which:

Referring more particularly to the drawings, FIG. 1 shows a conventional two-armed bracket with a pivot installed between the arms. The bracket is generally identified at 10, and the pivot 11 is shown with a set screw 12 in its threaded axial bore.

Figure 3:
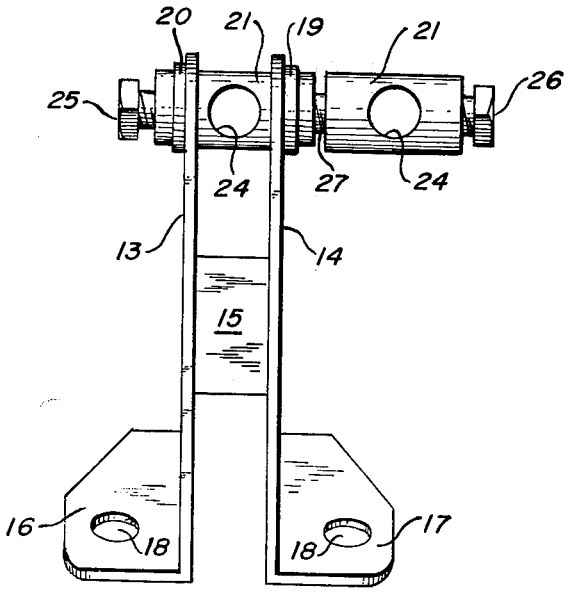
FIG. 3 is a front view showing the bracket of FIG. 1 with two pivots of the type shown in FIG. 2 used therewith, one between the arms of the bracket in conventional fashion, and the second at one side of the bracket.

The bracket 10 is more easily seen in FIG. 3 where it is constituted by parallel arms 13 and 14 held together by back plate 15 and having flanges 16 and 17 with mounting holes 18 which enable the bracket 10 to be secured to a blade. These holes 18 can be disregarded and the flanges 16 and 17 can be welded or otherwise secured to the blade.

The arms 13 and 14 extend beyond the end of the blade in conventional manner, and the outer ends of these arms carry opposed openings defined by circular flanges 19 and 20.

Figure 1:
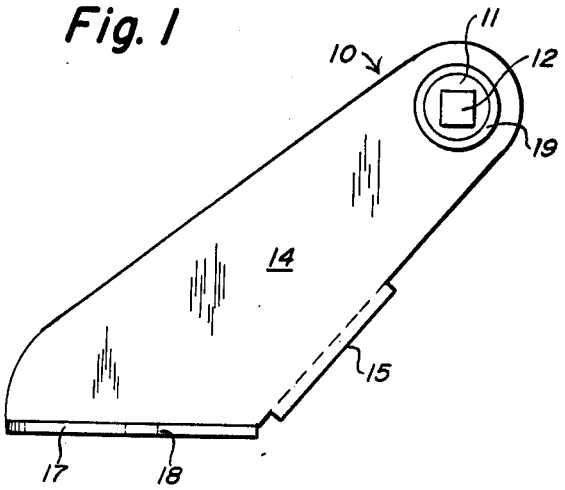
FIG. 1 is a side elevation of a conventional two-armed bracket having a pivot mounted between its arms.
Figure 2:
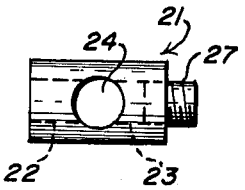
FIG. 2 is a plan view of a pivot modified in accordance with this invention to enable a second pivot to be carried at one side of the bracket. This view includes a threaded rod for holding two pivots together.

The pivot 11 in FIG. 1 may be conventional, or it may be modified for use in this invention, but the pivots 21 in FIG. 3 must be modified for this invention as shown in FIGS. 2 and 3. As can be seen in FIG. 2, the pivot body is cylindrical, and it is axially bored at both ends. Each of these bores is threaded, and they are identified at 22 and 23. A cross hole 24 extends through the body of the pivot and the threaded axial bores 22 and 23 communicate therewith. One such threaded bore accommodates a set screw as shown in FIG. 3 at 25 and 26. The other axial bores are used to rotatably hold the two pivots together with the second pivot at one side of the arms 13 and 14. This is done with a threaded rod 27 which can be termed a socket set screw.

The use of the brackets in a multi-blade damper is now the same as it was in U.S. Pat. No. 3,267,962. However, no preassembly is needed in that the pivots are not preconnected to the brackets. Indeed, they are never connected to the brackets, but rotate freely therein.

Figure 4:
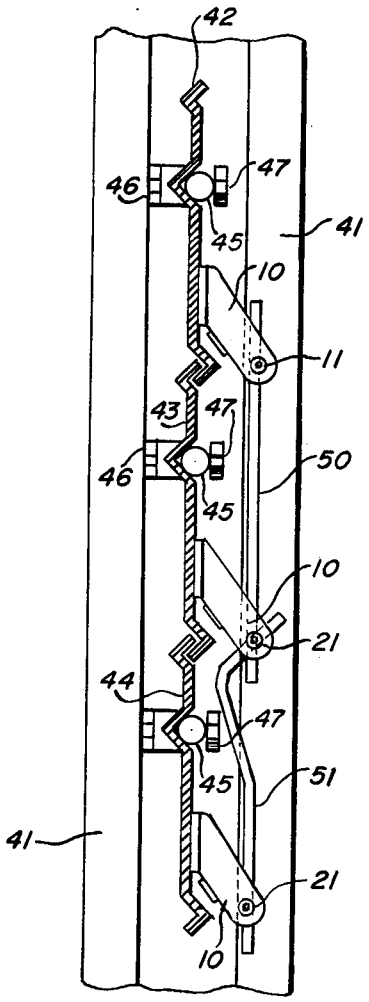
FIG. 4 is a partial cross-section through a multi-blade damper assembled in accordance with this invention.

A typical multi-blade damper application is shown in FIG. 4 in which 40 identifies a damper assembly of which only frame element 41 can be seen. Three blades 42, 43 and 44 are shown pivotally mounted (in their closed position) in the frame element 41. The pivotal mounting involves a retractable blade pin 45 held on by a bolt 46 and a lock nut 47, but the blades may be pivotally mounted in any conventional fashion.

Brackets 10 are shown mounted on a corresponding position on each of blades 42, 43 and 44. The upper blade 42 carries a single pivot which need not be modified as in this invention. The next blade 43 carries two pivots as shown in FIG. 3. A first rod 50 extends between the pivot 11 and the pivot carried by the bracket on blade 43 which is positioned between the arms of the bracket 10. However, a second pivot is also carried by the bracket on blade 43, and it is connected to rod 51. The rod 51 is shown bent so as to be easily distinguished in the drawings from rod 50, and also because straight rods illustrate the fact that mechanical precision is not a requirement of this invention. The lower end of rod 51 is carried in a second pivot 21 which is bracketed to blade 44.

It is possible to have the bracket on blade 44 the same as the one on blade 42, but this would mean laterally shifting the bracket and it is difficult to precisely do this.

It will also be appreciated that the blades are shown with overlapping edges, but these edges may be sealed as desired.

What is claimed is:

1. A multiblade damper assembly having at least three blades mounted to pivot between a closed position in which the blades are in the plane of a damper frame opening to block that opening, and an open position in which the blades are at an angle to the plane of the frame opening, means interlinking said blades comprising, a bracket secured to each of said blades, each of said brackets being formed with a pair of parallel extension arms which extend beyond an end of the blades, said extension arms having opposed openings for receiving a cylindrical pivot at their outer ends, a cylindrical pivot rotatably mounted between the arms of each of said brackets in the opposed openings on said arms, said cylindrical pivot having a threaded axial bore on at least one end thereof and a cross hole extending therethrough, at least one of said brackets having a second axially bored pivot with a cross hole extending therethrough rotatably secured to the pivot between the arms of said bracket, said second pivot extending to one side of said bracket, and connecting rods interconnecting pairs of blades by having the opposite ends of each rod secured within the cross holes of said pivots, including both of said rotatably interconnected pivots.

2. A multiblade damper as recited in claim 1 in which said rods are secured within said cross holes by set screws.

3. A multiblade damper as recited in claim 1 in which each of said rotatably interconnected pivots have axial threaded bores at each end thereof, and are interconnected by means of a threaded rod.

* * * * *